US011484084B2

(12) United States Patent
Abraham

(10) Patent No.: US 11,484,084 B2
(45) **Date of Patent: *Nov. 1, 2022**

(54) UNIVERSAL NON-HELMETED PROTECTIVE FACEMASK

(71) Applicant: Carl J. Abraham, Great Neck, NY (US)

(72) Inventor: Carl J. Abraham, Great Neck, NY (US)

( * ) Notice: Subject to any disclaimer, the term of this patent is extended or adjusted under 35 U.S.C. 154(b) by 111 days.

This patent is subject to a terminal disclaimer.

(21) Appl. No.: 16/952,697

(22) Filed: Nov. 19, 2020

(65) Prior Publication Data

US 2021/0321710 A1 Oct. 21, 2021

Related U.S. Application Data

(63) Continuation-in-part of application No. 16/903,225, filed on Jun. 16, 2020, now Pat. No. 11,432,601, which is a continuation-in-part of application No. 16/849,035, filed on Apr. 15, 2020.

(51) Int. Cl.

| | |
|---|---|
| ***A63B 71/10*** | (2006.01) |
| ***A42B 3/20*** | (2006.01) |
| ***A42B 3/24*** | (2006.01) |
| *A41D 13/05* | (2006.01) |
| *A42B 7/00* | (2006.01) |

(52) U.S. Cl.

CPC ..... *A42B 3/20* (2013.01); *A42B 3/24* (2013.01); *A42B 7/00* (2013.01)

(58) Field of Classification Search

CPC ..... A63B 71/10; A63B 2102/182; A63B 2102/22

See application file for complete search history.

(56) References Cited

U.S. PATENT DOCUMENTS

| | | | | | |
|---|---|---|---|---|---|
| 1,172,330 | A | * | 2/1916 | Welch | A42B 3/20 2/9 |
| 1,186,442 | A | * | 6/1916 | Schaefer | A42B 3/20 2/9 |
| 1,775,009 | A | * | 9/1930 | Weber | A63B 71/10 2/9 |
| 2,715,222 | A | * | 8/1955 | Sowle | A63B 71/10 2/9 |
| 4,031,564 | A | * | 6/1977 | Wood | A42B 3/22 2/9 |

(Continued)

*Primary Examiner* — Robert H Muromoto, Jr.

(74) *Attorney, Agent, or Firm* — Malloy & Malloy, P.L.; Robert M. Downey

(57) ABSTRACT

A protective non-helmeted single molded facemask for sports includes a frame structure formed of a polycarbonate polymer and an integrally molded rigid eye shield formed of a transparent polycarbonate polymer composition. The peripheral frame structure is structured and configured to engage a user's forehead, side and cheek facial structure and chin. An arrangement of vertical and horizontal bars in the lower portion of the face area of the facemask are structured and configured to protect the users nose and mouth from direct contact with external objects, while the rigid eye shield on the upper face area of the facemask protects the users eyes from direct impact and contact with external objects. Upper and lower straps extend from slotted openings on the sides of the facemask and are positioned and arranged to extend around the lower back of the wearer's head to secure the facemask on the wearer's head.

12 Claims, 6 Drawing Sheets

(56) References Cited

U.S. PATENT DOCUMENTS 4,736,466 A * 4/1988 Kallstrom ..... A63B 71/10 2/427
5,267,353 A * 12/1993 Milligan ..... A42B 3/20 2/9
5,335,371 A * 8/1994 Spessard ..... A63B 71/10 2/9
5,392,468 A * 2/1995 Leddick, III ..... A42B 3/0473 2/424
D366,348 S * 1/1996 Boone ..... D29/111
5,911,308 A * 6/1999 Chafitz ..... A63B 71/10 2/9
6,012,164 A * 1/2000 Deal, III ..... A63B 71/10 2/9
D423,727 S * 4/2000 Deal, III ..... D29/108
6,189,156 B1 * 2/2001 Loiars ..... A42B 3/28 2/9
6,499,139 B1 * 12/2002 Brown ..... A63B 71/10 2/9
6,802,079 B2 * 10/2004 Bush ..... A63B 71/085 128/857
6,854,128 B1 * 2/2005 Faulk ..... A45D 44/22 2/9
7,222,370 B2 * 5/2007 Gait ..... A61F 9/029 2/9
7,430,763 B1 * 10/2008 Santos ..... A42B 3/20 2/9
10,945,480 B2 * 3/2021 Romanski ..... A42B 1/004
2002/0134390 A1 * 9/2002 Salatka ..... A61F 9/045 128/857
2012/0222185 A1 * 9/2012 Erikson ..... A61F 9/026 2/11
2015/0150724 A1 * 6/2015 Arnette ..... A61F 9/025 2/439
2018/0214763 A1 * 8/2018 Nelson ..... A42B 3/20

* cited by examiner

UNIVERSAL NON-HELMETED PROTECTIVE FACEMASK

This non-provisional patent application is a Continuation-In-Part of co-pending non-provisional patent application Ser. No. 16/903,225, filed on Jun. 16, 2020, which is a Continuation-In-Part of co-pending non-provisional patent application Ser. No. 16/849,035 filed on Apr. 15, 2020.

BACKGROUND OF THE INVENTION

Field of the Invention

The present invention relates to protective facemasks, and more particularly, to a protective facemask for contact and non-contact sports and not attached to a helmet, and wherein the universal protective facemask is specifically designed to substantially reduce the risk of sports related eye injuries, face injuries, dental injuries and head and brain injuries, such as sub-concussive and full concussive brain injuries.

Discussion of the Related Art

Participants in contact sports are extremely vulnerable to traumatic impacts to their face and head due to intentional or inadvertent contact with player equipment (e.g., softballs both hit and pitched, hockey sticks, balls, pucks both lightweight and weighted, etc.), body to body contact such as elbows and head to head contact, a fall to the ground or coming into contact with a structure or other impediment.

There are over 250,000 softball teams in the U.S. playing fast pitch softball that involve approximately 3.5 million players. The rise of injuries to the face (including the eyes, nose, mouth, teeth and overall facial structure) as well as injuries to the head as a result of being struck by softballs both pitched and hit has led to increased concern about player safety. In particular, many softball players, especially catchers and pitchers, are wearing face protection masks, many of which are intended to be used with or without a helmet. However, existing face protection masks have proven to be problematic as they do not provide full protection for the eyes, nose, mouth and teeth. Additionally, the straps that hold the existing face protection masks on a player's head are not effective to hold the facemask in place when struck by a softball traveling at speeds in excess of 60 mph.

In another example, floor hockey has become a very popular gymnasium activity in elementary school, middle school and high school. There are millions of participants in elementary schools and high schools throughout the United States in those age groups participating in floor hockey during school. Participants in floor hockey are particularly vulnerable to eye and face injuries as a result of being hit in the face with a hockey stick or the ball or puck which can be traveling at speeds in excess of 60 mph. Moreover, participants in floor hockey, like many other contact sports, can receive traumatic impacts to the head and face as a result of head to head contact, a fall to the ground, an elbow to the head or coming into contact with a stationary structure or other impediment. The need for protection to reduce those risks is greater than ever and currently no existing facemask provides adequate protection against injuries to the face including the face, eyes, nose and mouth, as well as reducing the effective impact to the head and brain which could cause sub-concussive and full concussive brain injuries. Protection of the eyes, face and teeth has become a requirement in many schools. Protection of school children's maturing brains and head is also a significant concern.

In field hockey, as another example, approximately 75,000 athletes participate in high school and college around the United States. High school field hockey players have become stronger and more capable of hitting the ball faster and harder. More teams are involved in lifting the ball. This increases the risk of not only eye injuries but also brain injuries. Because of these risks, many schools are now requiring field hockey players to wear protective eyewear and facemasks.

In the United States alone, emergency rooms treat sports related eye injuries every 13 minutes. These injuries range from corneal abrasions and blunt trauma to penetrating injuries which can cause temporary or permanent vision loss in one or both eyes. Moreover, it is estimated that there are between 1.6 to 3.8 million sports related head and brain injuries resulting in sub-concussive or full concussive brain injuries.

Currently, the National Federation of State High School Associations (NFHS) requires all school field hockey participants to wear eye protection that meets America Society for Testing and Materials (ASTM F2713-09) standard for field hockey. The universal facemask of the present invention significantly exceeded the ASTM F2713-09 standard, and in testing by an independent laboratory it was verified that the universal facemask of the present invention consistently withstood impacts in excess of 80 mph (e.g., impact by a softball and hard hockey puck).

It is further noted that participants in outdoor sports such as, for example, softball, are constantly exposed to harmful UV rays from sunlight which can cause skin cancer, frequently on the face, as well as permanent damage to players' eyes.

Currently, there is no existing universal protective facemask in the related art that is worn independent of a helmet and which provides full protection to the face, eyes, nose, mouth and head, and which also absorbs and dissipates forces of impact to the facemask and user's head, while also absorbing and dissipating the user's perspiration. In particular, no existing facemask or eyewear protection exists that provides adequate protection against traumatic impacts to the face, eyes, mouth, teeth and head as a result of being struck by an instrument (e.g., a hockey stick or field hockey stick), elbows, a fall to the ground or impact forces of softballs, hardballs, pucks, soccer balls and lacrosse balls striking the participants head at over 80 mph. Moreover, there is no existing universal protective facemask in the related art that is worn on a helmet or independent of a helmet and which includes a glare proof polycarbonate eye shield molded as part of the one-piece facemask and wherein the polycarbonate eye shield is open at opposite sides to allow for greater ventilation which prevents fogging of the eye shield even when worn by athletes during highly strenuous sports activities wherein the wearer may be perspiring and breathing heavy, and further wherein the glare proof polycarbonate eye shield is manufactured to include a UV (ultraviolet) absorbing compound incorporated within the polycarbonate polymer for eliminating or significantly reducing the amount of exposure the wearer's eyes and face to UV rays from sunlight and/or other UV light sources.

Accordingly, there remains an urgent need in the sports industry for a universal protective facemask that fully protects against face and eye injuries, as well as injuries to the mouth and teeth, and which is further used in conjunction with a universal protective headgear, as described in my U.S. Pat. Nos. 10,383,386; 7,234,174; 6,978,487; and 6,675,395 the content of which are fully incorporated herein by reference, to thereby provide the added protection of absorption and dissipation of impact forces to the facemask and the user's head, as well as absorption and dissipation of the user's perspiration.

SUMMARY OF THE INVENTION

The universal protective facemask of the present invention is formed of a single mold of polycarbonate polymer and is shaped and configured to generally conform to the wearer's forehead, face and chin. More particularly, the universal protective facemask is formed and structured to engage the user's forehead, while extending around the sides of the wearer's head, and downwardly along the wearer's head, forward of the ears, to the chin, fully covering the chin area as well. The inner facing surfaces that engage the forehead, cheeks and chin are provided with padding for comfort. A soft polymeric material extends about the inside periphery on all surfaces that engage the face, thereby allowing for a comfortable non-irritating fit. Moreover, the cheek and forehead areas may include an impact absorbing polymeric material for absorbing and dissipating impact forces. The facemask is secured to the wearer's head by upper and lower straps that are fitted through slots on the opposite sides of the facemask and extend behind the wearer's head, below the curvature of the back of the head, to securely hold the facemask on the wearer's head while discouraging the facemask from being dislodged due to impact of the facemask with an object or other participants in any sports activity. The front of the facemask provides for protection against impact to the eyes, nose, mouth, teeth and overall facial structure of the wearer. In particular, the lower portion of the universal protective facemask, covering the nose and mouth is provided with an arrangement of vertical and horizontal bars or ribs that are integrally formed with the facemask out of the single mold of polycarbonate polymer material. The ribs are adequately spaced to prevent a softball, hockey stick, puck, ball or other instrument or object from making contact with the wearer's face including the nose and mouth. The upper portion of the front of the universal facemask is provided with a transparent polycarbonate glare proof polycarbonate eye shield that is also molded as part of the single one-piece and integral part of the facemask. The transparent glare proof polycarbonate eye shield allows for full and unobstructed vision of the wearer while participating in a sports activity. In particular, the transparent polycarbonate eye shield allows for unobstructed upward, downward, side to side and peripheral vision for maximum reaction time and safety, such as from an incoming ball or puck traveling at a speed in excess of 80 mph. The transparent polycarbonate eye shield is formulated with an ingredient that significantly reduces and/or eliminates glare from any bright light including sunlight. Moreover, the formulation of the polycarbonate transparent glare proof eye shield contains an ingredient that allows for clearer visibility of all action and movements of softballs, hardballs, pucks, lacrosse balls and other objects in a sports activity. The enhanced visibility of the polycarbonate eye shield is particularly useful for goaltenders in floor hockey, field hockey, soccer and lacrosse. In addition, the formulation of the transparent polycarbonate eye shield includes a UV absorbing compound that absorbs the UV rays prior to impacting the wearer's face and eyes, thereby significantly reducing harmful exposure to UV light from the sun and/or other UV light sources that might otherwise damage the wearer's facial skin and eyes. The eye shield properties of glare resistance and scratch resistance do not exist on any other facemask that is not part of a helmet. It should also be noted that the eye shield can be made to be entirely clear, with no tinting or shading, to meet certain requirements in various schools and/or floor hockey leagues. Making the eye shield entirely clear can be accomplished with a slight modification of the polycarbonate polymer. The eye shield on the facemask of the present invention is also the only facemask with an eye shield that does not fog. Specifically, the opposite sides of the eye shield are open to allow air flow into the facemask and behind the eye shield, while also providing increased ventilation when the wearer is breathing heavy. The open areas at opposite sides of the eye shield also allows for better peripheral vision. Additionally, the lower portion of the universal facemask having the vertical and horizontal ribs with open spaces between the ribs allows for unobstructed ventilation when breathing through the mouth and nose.

The universal protective facemask is used in conjunction with the universal protective headgear, as described in U.S. Pat. Nos. 10,383,386; 7,234,174; 6,978,487; and 6,675,395, to thereby allow for absorption and dissipation of impact forces of softballs, hardballs, pucks, soccer balls and lacrosse balls striking the facemask at speeds of approximately 80 mph or higher, while also allowing for the absorption and dissipation of perspiration. The universal facemask, in conjunction with the universal protective headgear, is the only protective facemask that will provide for protection against sports related eye injuries, nose, face, dental and mouth injuries, as well as significantly reducing the effective impact to the head and brain and reducing the risk of sub-concussive and full concussive brain injuries in addition to having a glare proof, non-fogging integral eye shield. The universal facemask is self-contained and not attached to any protective helmet. The universal protective headgear can be attached to the universal protective facemask or worn as a separate article, but still used in conjunction with the universal protective facemask.

The universal facemask of the present invention is particularly useful and intended for use in the following sports activities:

Contact Sports
Field hockey
Floor hockey
Goal tender in soccer
Women's lacrosse
Non-Contact Sports
Softball—adult and children, male and female; slow pitch and some fast pitching

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
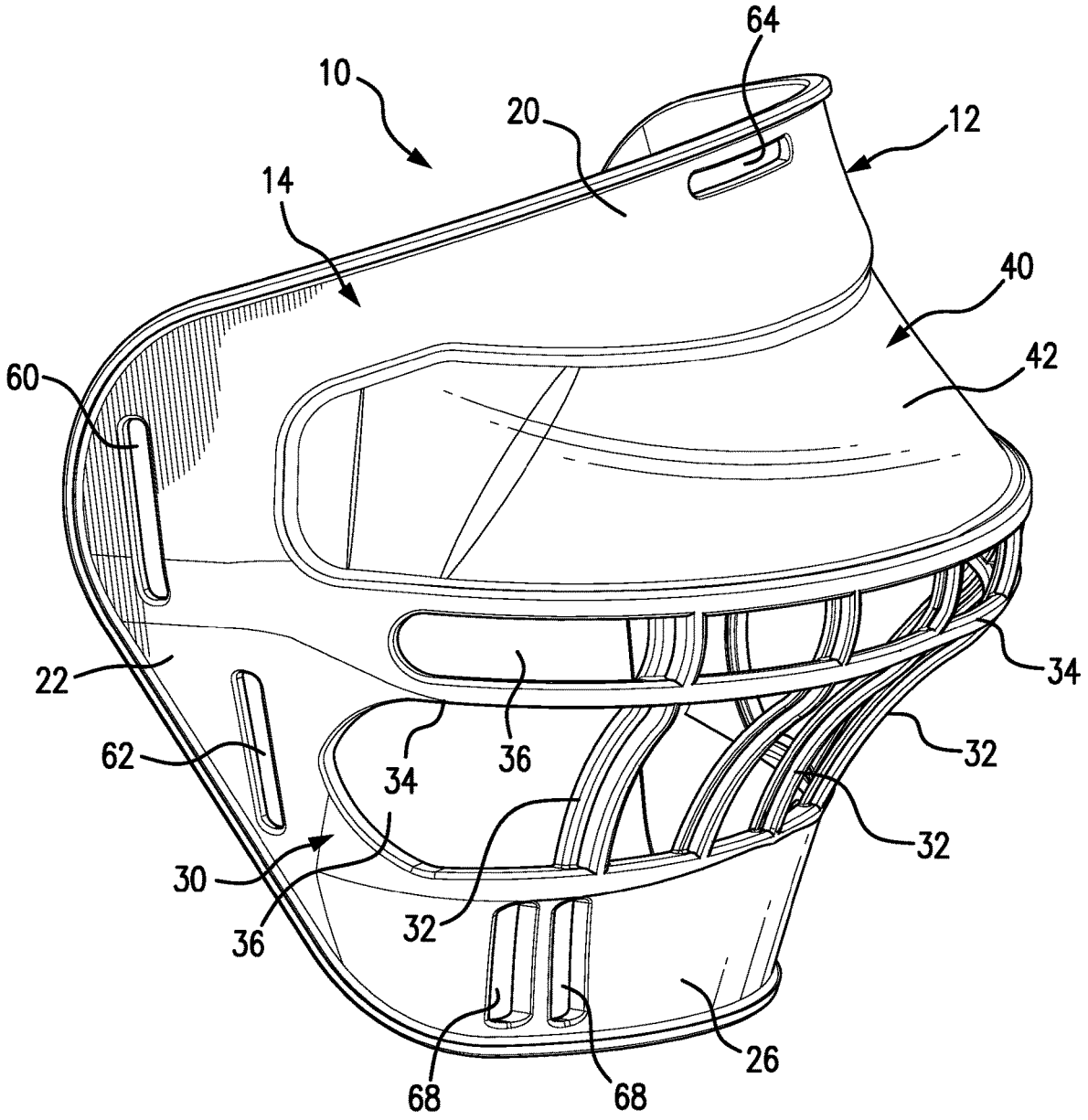
FIG. 1 is a side, front perspective view of the universal facemask of the present invention.
Figure 2:
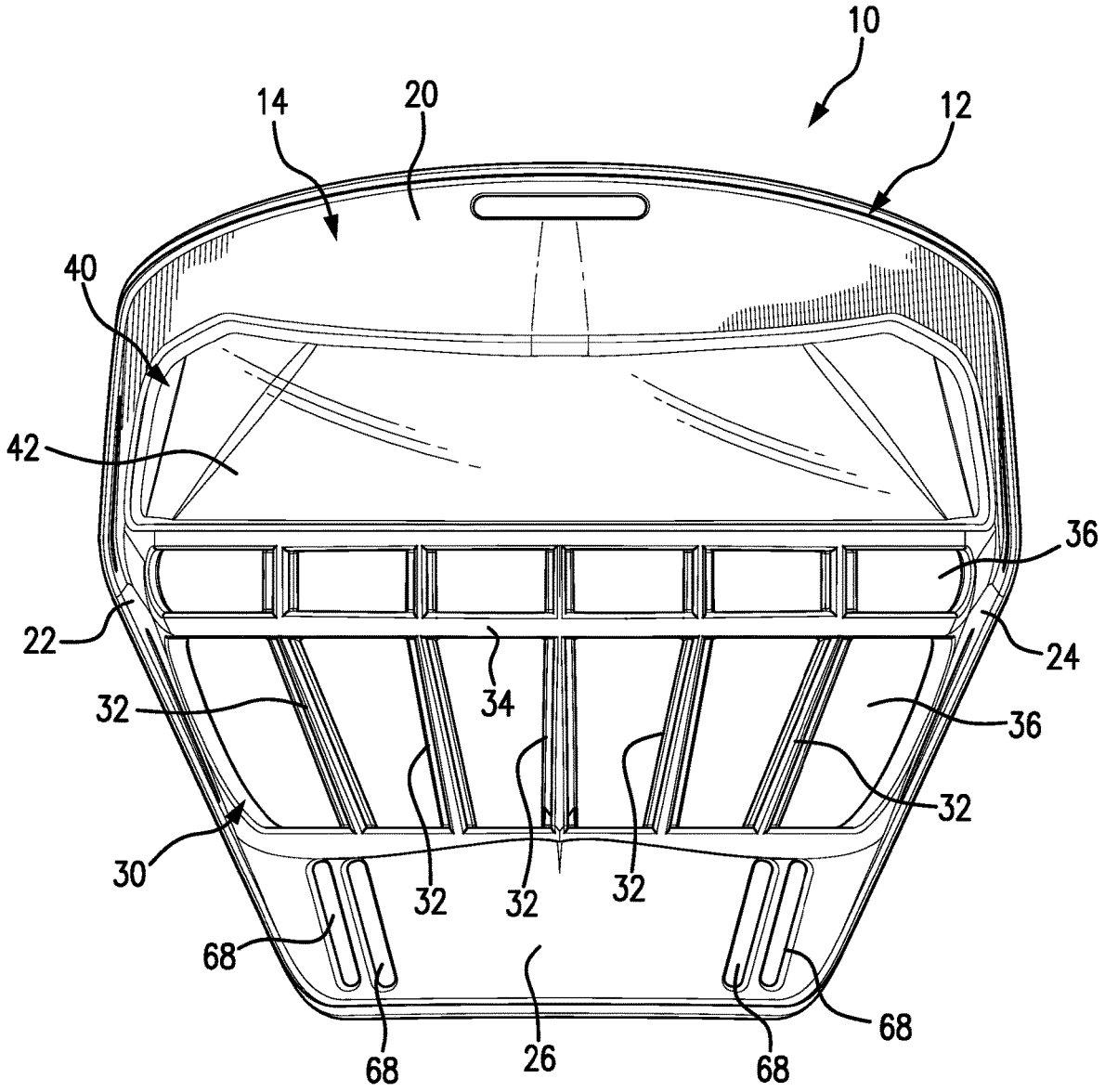
FIG. 2 is a front elevational view of the universal facemask of the present invention.

Referring to FIGS. 1-4, the non-helmeted single molded universal protective facemask of the present invention is shown and is generally indicated as 10. The universal facemask includes a single molded structure 12 formed of a polycarbonate polymer and including a peripheral frame structure 14 that is shaped, structured and configured to engage the user's forehead, side and cheek facial structure and chin, and includes a forehead portion 20, opposite sides 22, 24 and a lower portion 26 that extends in front of the wearer's chin.

The non-helmeted single molded universal protective facemask 10 further includes a lower face area 30 and an upper face area 40. The lower face area 30 includes an arrangement of protective bars or ribs including an arrangement of spaced vertical bars 32 and at least one horizontal bar 34 intersecting with each of the vertical bars 32 to create openings 36 between the bars. It should be noted that the openings 36 are not large enough to allow the end of a hockey stick, floor hockey ball or puck or softball to penetrate through the openings 36, thereby preventing contact with the user's face including the mouth, teeth, jaw and nose.

The upper face area 40 includes an integrally formed transparent eye shield 42 that is part of the single molded structure of the universal protective facemask. The rigid eye shield 42 is formed of a transparent polycarbonate polymer composition and covers the upper face area. The rigid transparent eye shield is structured and disposed for protecting the user's eyes from direct impact and contact with external objects, including hockey sticks, balls, pucks, softballs and other objects, as well as elbows, fingers and other body parts of participants in the sports activities, as described above. The transparent rigid eye shield 42 is preferably formulated to be glare proof, while allowing for full and unobstructed vision of the wearer while participating in the sports activity. The transparent rigid eye shield 42 is formulated with an ingredient that significantly reduces and/or eliminates glare from any bright light including sunlight. This ingredient can include any of a variety of color pigments to provide a vast selection of colors of the eye shield. However, it should be noted that the transparent rigid eye shield 42 can be made to be entirely clear by simply modifying the formulation of the polycarbonate polymer. Additionally, the formulation of the transparent polycarbonate eye shield includes a UV absorbing compound that eliminates or significantly reduces the amount of UV rays impacting the wearer's face and eyes, thereby significantly reducing harmful exposure to UV light from the sun and/or other UV light sources that might otherwise damage the wearer's facial skin and eyes.

Figure 3:
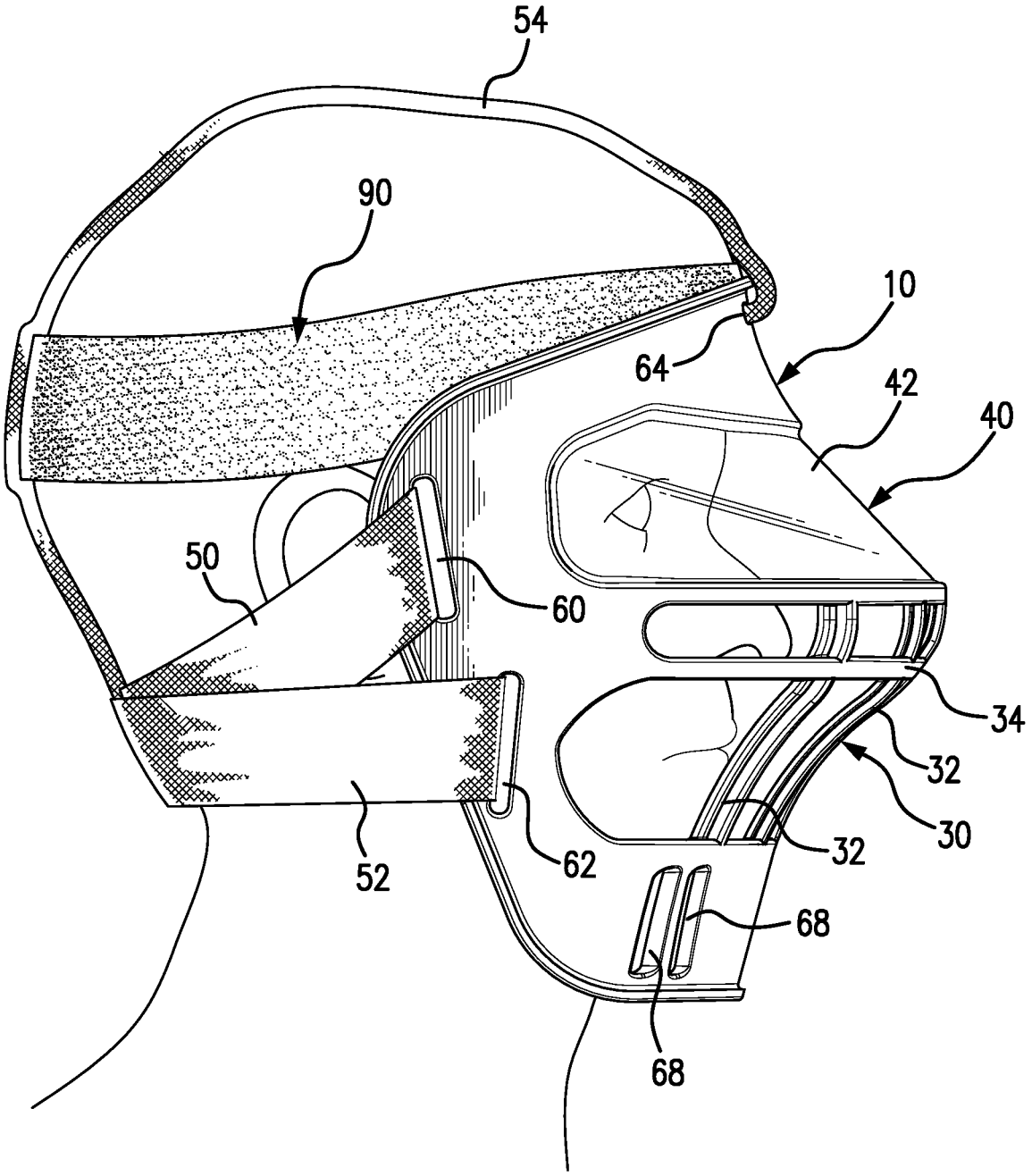
FIG. 3 is a side elevational view showing the universal facemask of the present invention worn on a user's head and in conjunction with the universal headgear and showing the securing straps of the universal facemask extending from the side angled slots of the facemask to the back of the wearer's head below the curvature on the back of the wearer's head.

As seen throughout the several views of the drawings, the non-helmeted single molded universal protective facemask further includes an arrangement of slots to accommodate straps that secure the universal protective facemask on the wearer's head, as seen in FIG. 3. More particularly, the universal protective facemask 10 includes a pair of slots on each of the sides 22, 24, including upper slots 60 and lower slots 62. The universal protective facemask 10 further includes a slot 64 in the center of the forehead portion 20, for attachment of a center strap that may be used and which would extend over the top of the wearer's head, as seen in FIG. 3. As seen in FIG. 3, an upper strap 50 is secured through the upper slots 60 on opposite sides of the facemask, while a lower strap 52 is secured to the lower slots 62 on the opposite sides of the facemask. The upper slots 60 and lower slots 62 are specifically positioned and arranged to angle the position of the upper strap 50 and the lower strap 52 so that the upper and lower straps 50, 52 extend behind the wearer's head, below the back curvature of the head, with the upper strap 50 meeting the lower strap 52 at the back of the wearer's head, as seen in FIG. 3. To enhance the secure attachment of the universal protective facemask 10 over the wearer's face, as see in FIG. 3, and to discourage dislodging or undesirable movement, an upper strap 54 may further be used. As previously described, the upper strap 50 secures to the top center slot 64 on the forehead portion 20 of the universal protective facemask 10 and extends over the top of the wearer's head, down the back of the head and joins the upper and lower straps 50, 52 behind the wearer's head, below the back curvature of the wearer's head.

The universal protective facemask 10 may further be provided with ventilation slots 68 along the lower portions 26 to assist with ventilation and antifogging of the rigid eye shield 42. As described above, the openings 36 between the vertical and horizontal bars 32, 34 allow for sufficient ventilation while the wearer breaths during the sports activity, to prevent fogging of the rigid eye shield 42.

Figure 4:
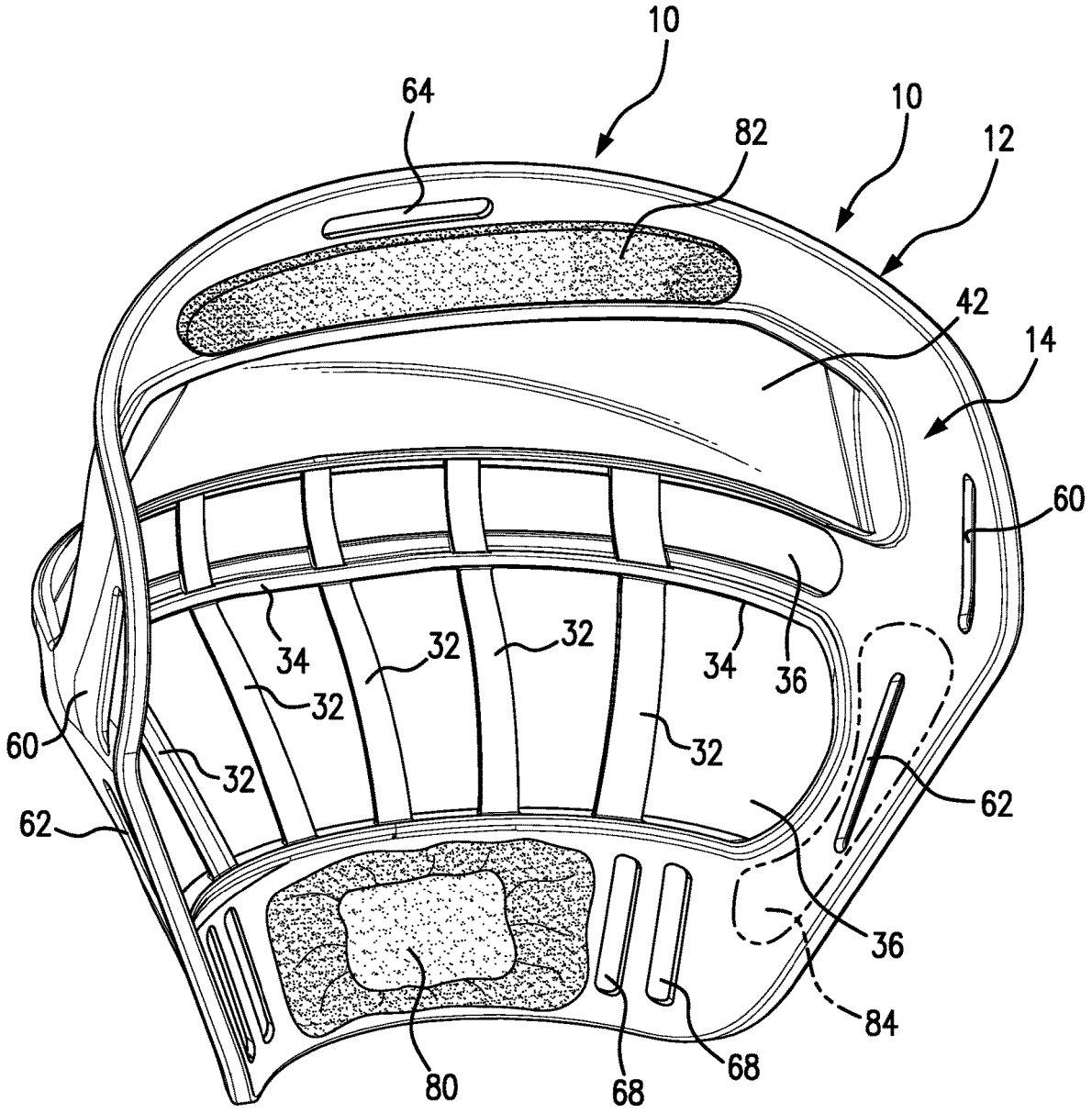
FIG. 4 is a rear perspective view of the universal facemask showing the inner surfaces of the facemask including a chin support and cheek engagement pads.

Referring to FIG. 4, for added comfort and to help secure the universal protective facemask 10 on the wearer's head, a chin pad 80 is provided, as well as a forehead pad 82. Additionally, cheek pads 84 may be provided on the opposite inner facing surfaces of the sides 22, 24 of the facemask. A soft polymeric material extends about the inside periphery on all surfaces that engage the face, thereby allowing for a comfortable non-irritating fit.

Figure 5:
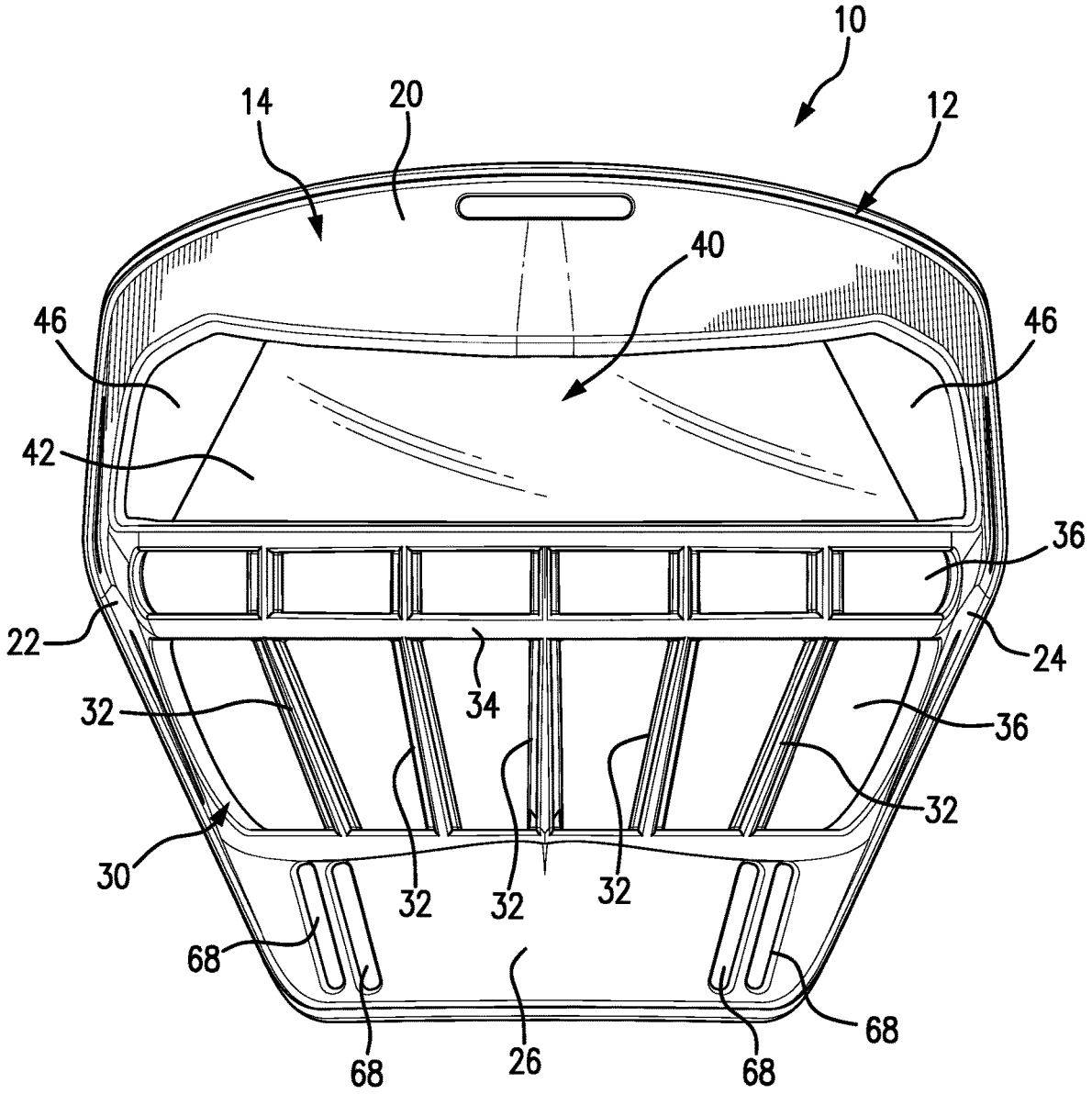
FIG. 5 is a front elevational view of the universal facemask according to a further embodiment, wherein the transparent eye shield is open at opposite sides.
Figure 6:
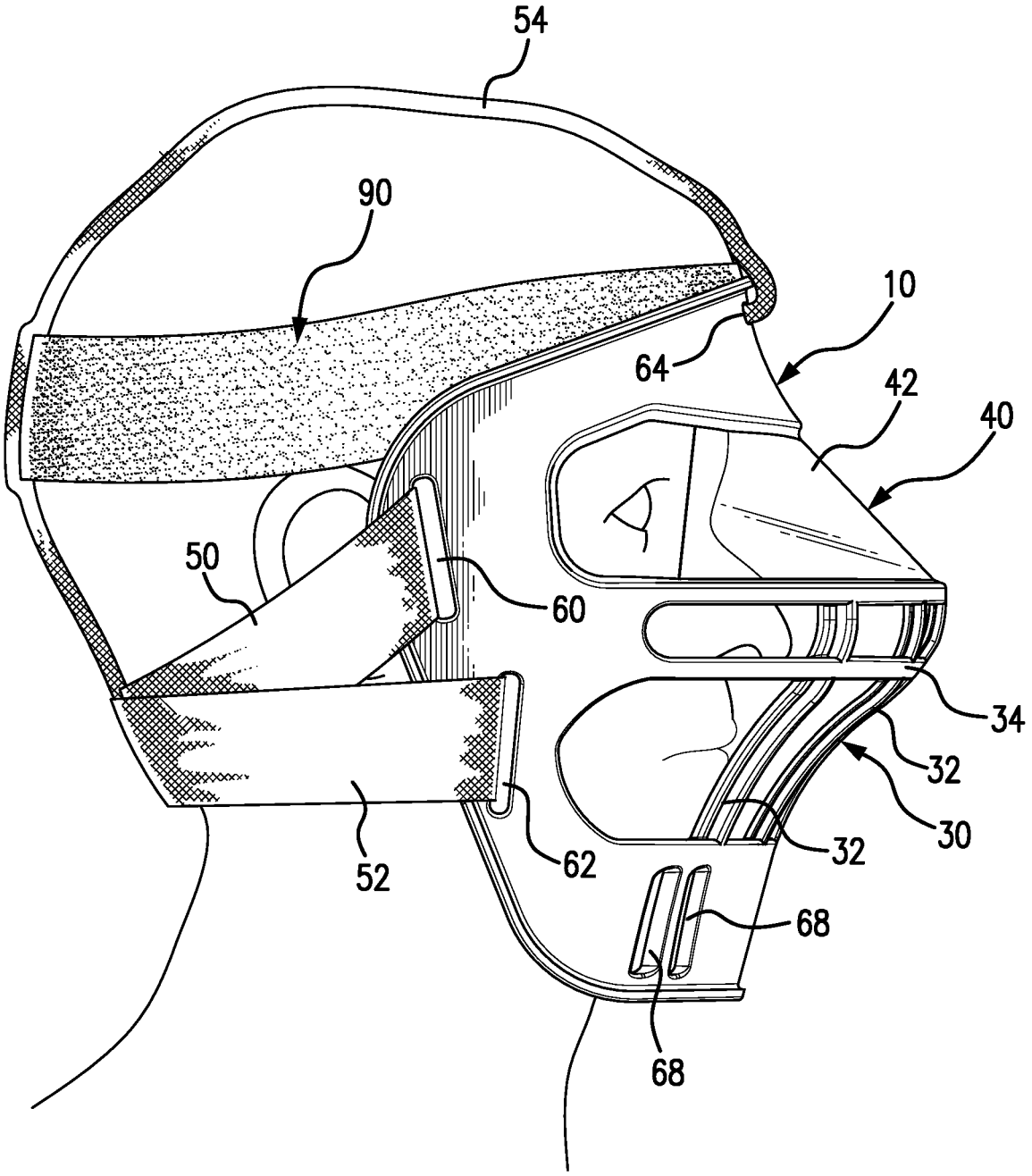
FIG. 6 is a side elevational view showing the universal facemask of FIG. 5 worn on the user's head and in conjunction with the universal headgear, and wherein the open areas on opposite sides of the eye shield allows for greater ventilation to prevent fogging of the eye shield.

Referring to FIGS. 5 and 6, a further embodiment of the single molded universal protective facemask 10 includes open areas 46 at opposite sides of the transparent rigid eye shield 42 to allow for greater air flow and ventilation that eliminates fogging of the eye shield even when the wearer is hot, perspiring and breathing heavy when participating in a sports activity. The open areas 46 at opposite sides of the eye shield 42 also provide for better peripheral vision of the wearer.

As previously described, the universal protective facemask 10 can be worn in conjunction with the universal protective headgear 90, as seen in FIG. 3. The universal protective headgear 90 can be attached to the universal protective facemask 10 or worn as a separate article, but still used in conjunction with the universal protective facemask 10.

While the present invention has been shown in accordance with a preferred and practical embodiment, it is recognized that departures from the instant disclosure are fully contemplated within the spirit and scope of the present invention which is not to be limited except as defined in the following claims as interpreted under the Doctrine of Equivalents.

What is claimed is:

1. A protective non-helmeted single molded facemask for contact sports and non-contact sports comprising:

a peripheral frame single molded structure formed of a polycarbonate polymer and being configured and structured to engage a user's forehead, side and cheek facial structure and chin, and the peripheral frame structure surrounding a face area including an upper face area and a lower face area;

an arrangement of vertical and horizontal bars in the lower portion of the face area integrally formed with the peripheral frame structure of the polycarbonate polymer material and the arrangement of vertical and horizontal bars being structured and configured to protect the user's nose and mouth from direct contact with external objects;

a rigid eye shield formed of a transparent polycarbonate composition, and the rigid eye shield extending across a front of the upper face area and terminating at opposite side edges adjacent left and right side open areas of the upper face area to allow air flow and ventilation that prevents fogging of the eye shield while also providing better peripheral vision of the wearer, and the rigid transparent eye shield being structured and disposed for protecting the user's eyes from direct impact and contact with external objects;

the transparent polycarbonate composition of the rigid eye shield including an ultraviolet light absorbing compound that protects against the ultraviolet rays passing through the rigid eye shield and onto the user's face and eyes;

the combined structure of the peripheral frame, the rigid eye shield and the arrangement of vertical and horizontal bars are integrally molded as a single unitary structure;

a pair of slots on a left side of the peripheral frame and a pair of slots on a right side of the peripheral frame and each pair of slots including an upper slot and a lower slot, and a top center slot in the peripheral frame at a location that is positioned over the user's forehead; and an upper strap secured at opposite ends to the upper slots on the left and right sides of the peripheral frame structure of the facemask and a lower strap secured at opposite ends to the lower slots on the left and right sides of the peripheral frame structure of the facemask, and the upper and lower slots on the left and right sides of the peripheral frame being positioned and arranged to angle the upper and lower straps so that the upper and lower straps extend around the lower back of the wearer's head, and a top strap secured at a first end to the top center slot of the peripheral frame and extending over the top of the wearer's head, down the back of the head and joining the upper and lower straps at the lower back of the wearer's head to secure the facemask on the wearer's head in a fully protective position over the wearer's face including the wearer's forehead, eyes, nose, mouth, cheekbones and chin and to discourage the facemask from being dislodged from the fully protective position.

2. The protective non-helmeted single molded facemask as recited in claim 1 wherein the combined structure of the peripheral frame, the arrangement of vertical and horizontal bars and the rigid eye shield provide full protection to the face, eyes, nose, mouth and teeth of a wearer.

3. The protective non-helmeted single molded facemask as recited in claim 2 further comprising a protective headband that includes an outer material that is structured and disposed to absorb and dissipate the wearer's perspiration and an inner polymer material structured and disposed to absorb and dissipate significant forces of impact to the wearer's head.

4. The protective non-helmeted single molded facemask as recited in claim 3 wherein the combination of the protective facemask and the headband absorbs and dissipates forces of impact to the facemask and the wearer's head, and absorbs and dissipates the wearers perspiration.

5. The protective non-helmeted single molded facemask as recited in claim 4 wherein the headband is worn as a separate component in combination with the facemask.

6. The protective non-helmeted single molded facemask as recited in claim 4 wherein the protective headband is removably attached to the inner surface of the facemask.

7. The protective non-helmeted single molded facemask as recited in claim 1 wherein an inner surface of the peripheral frame single molded structure includes at least one cushioning pad attached thereto for providing increased comfort to the wearer.

8. The protective non-helmeted single molded facemask as recited in claim 1 wherein the transparent polycarbonate composition of the rigid eye shield is formulated to provide glare resistance from any bright light including sunlight.

9. The protective non-helmeted single molded facemask as recited in claim 1 wherein the transparent polycarbonate composition of the rigid eye shield is formulated to provide scratch resistance.

10. The protective non-helmeted single molded facemask as recited in claim 1 wherein the transparent polycarbonate composition of the eye shield is formulated to be clear.

11. The protective non-helmeted single molded facemask as recited in claim 1 wherein the transparent polycarbonate composition of the eye shield is formulated to include any of a plurality of colors.

12. The protective non-helmeted single molded facemask as recited in claim 4 wherein the combination of the protective facemask and the headband is structured and disposed to absorb and dissipate forces of impact from baseballs and softballs striking the facemask at velocities in excess of 80 mph and thereby significantly reducing impact forces to the wearer's face and head to protect the wearer's face and head from injury.

* * * * *